US007384532B2

(12) United States Patent
Parsons, II et al.

(10) Patent No.: US 7,384,532 B2
(45) Date of Patent: Jun. 10, 2008

(54) PLATABLE COATING AND PLATING PROCESS

(75) Inventors: Dennis R. Parsons, II, Alto, MI (US); Ling Hao, Grand Rapids, MI (US); Daniel W. Irvine, Kentwood, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 442 days.

(21) Appl. No.: 10/989,797

(22) Filed: Nov. 16, 2004

(65) Prior Publication Data

US 2006/0102487 A1 May 18, 2006

(51) Int. Cl.

| | |
|---|---|
| ***C25D 5/54*** | (2006.01) |
| ***C25D 5/56*** | (2006.01) |
| ***C23C 28/00*** | (2006.01) |
| ***C23C 20/02*** | (2006.01) |

(52) U.S. Cl. ..... 205/159; 205/160; 205/163; 205/167; 205/169; 205/183; 205/187

(58) Field of Classification Search ..... 205/159, 205/163, 167, 169, 183, 187, 160
See application file for complete search history.

(56) References Cited

U.S. PATENT DOCUMENTS

| | | | | |
|---|---|---|---|---|
| 4,668,736 | A * | 5/1987 | Robins et al. | 525/65 |
| 6,110,993 | A * | 8/2000 | Saito et al. | 523/211 |
| 6,468,672 | B1 | 10/2002 | Donovan, III et al. | 428/626 |
| 6,749,949 | B2 | 6/2004 | Ljungar et al. | 428/524 |
| 6,762,381 | B2 * | 7/2004 | Kunthady et al. | 200/512 |
| 2002/0197492 | A1 | 12/2002 | Hao et al. | |
| 2003/0205481 | A1 | 11/2003 | Xu et al. | |
| 2004/0038068 | A1 * | 2/2004 | Finch et al. | 428/626 |
| 2006/0086620 | A1 * | 4/2006 | Chase et al. | 205/164 |

FOREIGN PATENT DOCUMENTS

| | | | |
|---|---|---|---|
| JP | 62124279 | A * | 6/1987 |

* cited by examiner

*Primary Examiner*—Edna Wong
(74) *Attorney, Agent, or Firm*—Price, Heneveld, Cooper, Dewitt & Litton, LLP

(57) ABSTRACT

A process that can be uniformly employed for electroplating a wide variety of different non-conductive substrates, including those that are non-platable or difficult-to-plate using conventional electroless and electrolytic plating techniques involves application of a platable coating composition to the substrate prior to plating. The platable coating composition is cured to render the substrate more receptive to conventional plating techniques. In one embodiment, the process utilizes an epoxy resin system that upon being cured is receptive to electroless plating and electrolytic plating techniques that are the same or similar to those conventionally employed for electroplating ABS and/or PC/ABS substrates.

11 Claims, 1 Drawing Sheet

PLATABLE COATING AND PLATING PROCESS

FIELD OF THE INVENTION

The invention relates to electroplating of electrically non-conductive materials, and more particularly to preparing non-platable or difficult-to-plate materials for electroplating.

BACKGROUND OF THE INVENTION

Decorative chrome finishes and other metallic finishes on plastic components are highly desired for automotive, appliance and teletronic components, as well as for other components used in a variety of household products. Such components are desirable for their relatively low cost, lightweight and attractive appearance. However, the electroplating of metallic finishes on plastic substrates has generally been limited to relatively few plastic substrates. In particular, techniques have been developed for commercially electroplating acrylonitrile-butadiene-styrene (ABS) resin substrates and polymer alloys of polycarbonate (PC) and ABS to provide commercially successful, high-volume production of metal plated plastic components. Other plastic substrates that have been electroplated on a smaller scale include those comprised of polyamides, polyolefin resins, polyvinyl chloride, and phenol-formaldehyde polymers.

However, there are many relatively new engineering plastic materials and composite non-conductive materials that have been developed to meet the challenges for the stringent requirements of engineering performance in a wide variety of applications. Many of these materials cannot be electroplated using the processes conventionally employed for electroplating ABS and PC/ABS polymer alloys, and many other non-conductive plastics and composites cannot be electroplated easily and/or can only be electroplated using modified processes customized for the particular material.

It is extremely inconvenient and expensive (for the manufacturer and hence for the consumer) to modify and adjust electroplating processes to accommodate a large variety of different non-conductive substrates. Accordingly, there is a need for an improved process that can be uniformly applied to electroplate various non-conductive substrates that are either unplatable or difficult-to-plate using conventional techniques employed for electroplating ABS and/or PC/ABS polymer alloys.

SUMMARY OF THE INVENTION

The invention provides an improved process for electroplating a large variety of plastic and composite non-conductive materials that are unplatable or difficult-to-plate using conventional techniques employed for electroplating substrates comprised of ABS and/or PC/ABS polymer alloys, and the resulting plated articles. More specifically, the invention involves the use of a platable coating composition that is applied to the substrate to render the substrate more receptive to conventional electroless and electrolytic plating techniques that may be identical to those techniques customarily used for electroplating ABS and/or PC/ABS polymer alloys, or which may be only slightly modified from conventional ABS and/or PC/ABS polymer alloy electroplating processes.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
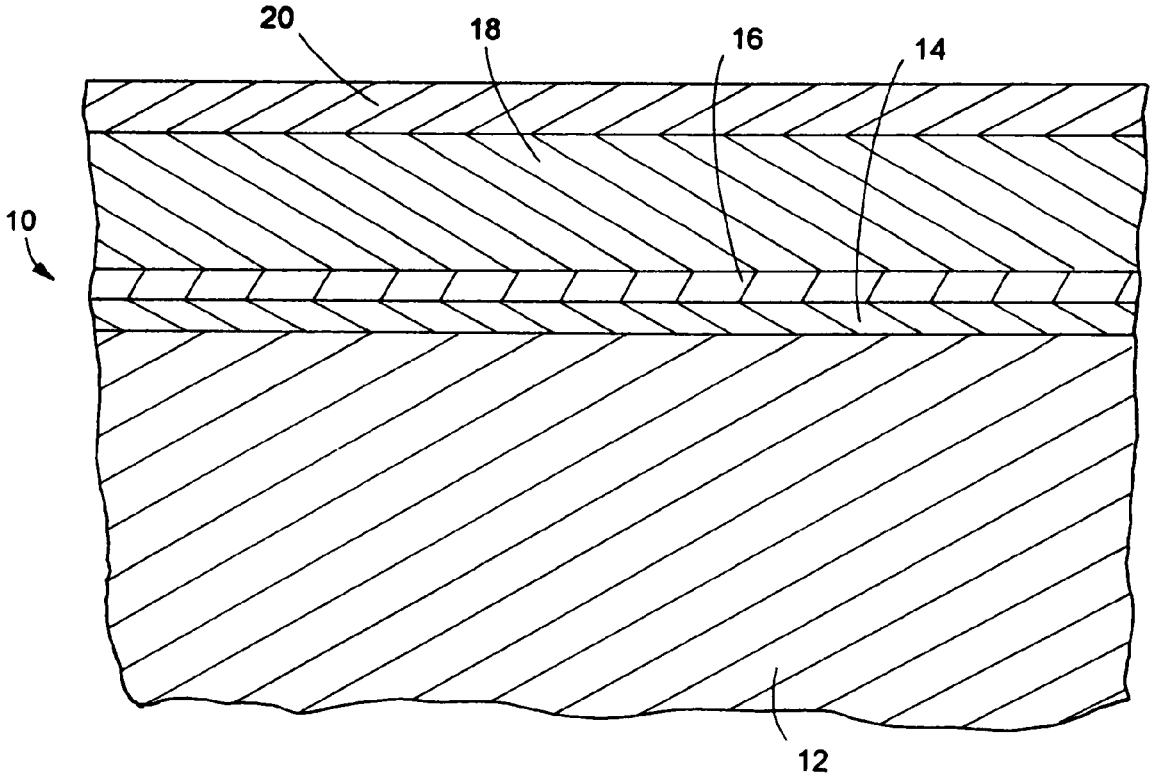
FIG. 1 is a schematic cross section of an electroplated substrate in accordance with an aspect of the invention.

The processes of this invention generally involve application of an electroplatable coating to a substrate, followed by conventional electroplating techniques that are the same or similar to techniques typically employed for electroplating ABS and/or PC/ABS polymer alloys.

An embodiment of the invention is schematically illustrated in FIG. 1, which shows an electroplated plastic article 10 comprising a plastic substrate 12 (e.g., polycarbonate, thermoset polyacrylate resin, thermoset polyester resin, or other difficult-to-plate substrate) on which a platable coating 14 is applied. Thereafter conventional electroless plating and electroplating techniques may be utilized to provide an electrolessly deposited metallic coating layer 16, and one or more electroplated metal layers 18 (e.g., copper, nickel, particle nickel, etc.). Typically, the article is provided with a relatively thin decorative layer 20 (e.g., chrome).

Although the invention may be employed for electroplating generally any type of substrate, the advantages of the invention are most evident when the process of the invention is applied to electroplating difficult-to-coat non-conductive substrates. Non-conductive substrates are substrates that do not exhibit sufficient electrical conductivity to facilitate efficient and economical electroplating of a metal layer onto the substrate. In general, non-conductive substrates include most thermoplastic substrates, most thermoset substrates, cellulosic substrates, (e.g., wood), glass substrates, and ceramic substrates. Difficult-to-coat substrates are those substrates that cannot be economically and efficiently electroplated using conventional electroplating techniques that are the same or similar to electroplating techniques used for ABS and/or PC/ABS polymer alloy substrates. Such conventional electroplating techniques may involve preparation of the substrate for electrolytic deposition of a metal, including an electroless plating process in which a non-conductive substrate is rendered electrically conductive. In this regard, difficult-to-electroplate substrates include substrates that cannot be easily and/or economically electrolessly plated. Examples of such substrates include polycarbonate thermoplastic substrates (which are different from PC/ABS polymer alloys), and various thermoset resins, including reinforced (e.g., with glass flakes, glass fibers, carbon fibers, reinforcing fillers, etc.) and non-reinforced thermoset materials obtained by curing unsaturated polyester resins, thermosettable resins (e.g., unsaturated polyacrylate resins, etc.). Accordingly, substrates that can be advantageously electroplated using the processes of this invention include substrates prepared from sheet molding compounds (SMCs) and bulk molding compounds (BMCs).

While it is not essential, it is typically desirable to inspect the difficult-to-coat component (e.g., plastic or fiber-reinforced thermoset) prior to application of a platable resin coating that facilitates employment of conventional electroplating techniques, and to scrap or repair any defective components to reduce or eliminate the possibility of electroplating unsalvageable components. Defects in repairable components may be filled with commercially available plastic filler compositions, such as BONDO® filler or Adtech No. 17 SMC-R, using the procedures for mixing, curing and finishing that are provided by the filler manufacturer, and/or sanded to eliminate minor imperfections. It may also be desirable to pre-bake (e.g., heat for a time and at a temperature that is effective for degassing the substrate without decomposing, melting or degrading the mechanical properties of the component) the components, especially those subjected to repair with a filler composition, to expel any trapped gasses. In the case of glass fiber reinforced thermosets (such as cured unsaturated polyesters), a suitable bake time is about one hour at about 180° F.

In the case of polycarbonate components and the components made of other materials typically having a very smooth surface, it is desirable to increase the roughness of the surface to enhance application and adhesion of the platable coating. This can be achieved by sanding with a sandpaper (e.g., a 600 grit sandpaper) as needed, or by sandblasting as needed. Desirably, such components are pre-baked as described above to expel any trapped gasses.

In some cases, it is desirable to further prepare the component prior to application of the platable resin coating by applying a primer coating layer. Such primer coatings may have a thickness of from about 2 to about 5 mils (0.002 to 0.005 inches) upon application to achieve a final solid film thickness of from about 1 to about 3 mils. Suitable primer coatings may be applied using commercially available primer compositions such as BONDO® EVERCOAT Z-GRIP® primer or MARAR-HYDE QUICKSAND® primer. Typically, the use of a primer coating is unnecessary for thermoplastic components having a smooth surface prior to roughening of the surface (e.g., polycarbonate components). However, application of a primer coating prior to application of the platable resin coating is typically beneficial for thermoset materials, such as those derived by curing unsaturated polyesters or unsaturated polyacrylates. It is generally advantageous to follow the instructions of the primer manufacturer with respect to curing. After curing of the primer, it is generally beneficial to sand the primed components, rinse and wipe clean (such as with a mixture of water and isopropanol), and dry completely before applying the platable resin coating.

After the component has been prepared, if necessary or desired, as described above, the platable resin coating is deposited on the surface of the component or primed component. The platable coating may be applied such as by spraying, dipping or by other suitable coating techniques. A suitable platable coating thickness is from about 2 to about 5 mils upon application (depending on the formulation of the coating composition) to achieve a dry film thickness of from about 1 to about 2 mils. After application, the coating is dried and cured. Desirably, the coating composition is formulated to allow curing to be completed in about one hour or less at a temperature of about 180° F. or lower. Additional platable coating may be spot applied to the component and cured as necessary for the plating process. Typically, it is desirable to allow the platable coating to post-cure at ambient temperature (e.g., at a normal manufacturing facility temperature, such as from about 50° F. to about 85° F.) for a period of about 24 hours.

A platable coating composition is generally a liquid composition that can be coated onto a substrate and cured (solidified) to form a solid film that is susceptible to electroless plating and subsequent electroplating techniques.

A suitable platable coating that may be applied to an unplatable or difficult-to-plate non-conductive component substrate prior to electroplating is an epoxy resin coating system. Epoxy resin compositions or systems comprise molecules (typically oligomers) containing at least two epoxide groups (oxirane functionalities) that have the ability to react with cross-linkers (also known as curing agents) via the epoxide groups to generate three-dimensional networks that provide a cured (solidified) product that exhibits rigidity, hardness, and an inability to melt and flow upon reheating (i.e., the cured product is a thermoset material, and is not a thermoplastic material). The thermoset (cured) epoxy resin coating films generally exhibit excellent electoplatability properties and excellent adhesion to a variety of thermoset and thermoplastic substrates. The cross-linkers (curing agents) used to react with the epoxy functionalized molecules are typically compounds having active hydrogens attached to a nitrogen, oxygen or sulfur atom. The most common epoxy resins are glycidyl ethers of alcohols or phenolics, such as the diglycidyl ether of bisphenol A (4,4'-isopropylidenediphenol). The cross-linkers are typically polyamines (i.e., molecules having a plurality of primary and/or secondary reactive amine functional groups), including aliphatic, aromatic and cycloaliphatic amines. The cross-linkers typically have at least three active hydrogens attached to nitrogen atoms and the epoxy functional molecules (typically oligomers) generally have two reactive epoxide groups at opposite terminals.

Epoxy resin systems designed for heat-cured reactions contain little or no plasticizers, while those designed for room temperature curing typically employ plasticizers to ensure complete reaction. Viscosity modifiers, such as fumed silica, may be utilized in the epoxy resin systems to help suspend fillers incorporated into the system prior to curing. Examples of aliphatic amines that may be employed include diethylenetriamine and aminoethyl piperazine. Examples of cyclaliphatic amines include 1,2-diaminocyclohexane, isophoronediamine and methylene biscyclohexanamine. Examples of aromatic amines include methaphenylenediamine and methlenediaminedianilene. Amidoamine cross-linkers may also be employed. Latent amines, such as dicyanamide, may be used to provide a one-package epoxy resin system having an extended shelf-life.

Suitable epoxy resins are commercially available and/or may be prepared by the reaction of epichlorohydrin with mononuclear di- and tri-hydroxyphenolic compounds such as resorcinol and phloroglucinol, selected polynuclear polyhydroxy phenolic compounds such as bis(p-hydroxyphenyl) methane and 4,4'-dihydroxybiphenyl, or aliphatic polyols such as 1,4-butanediol and glycerol.

Other thermosettable resins may optionally be included in the epoxy resin system. Examples include polyurethanes, polyureas, polyamides, brominated epoxies, phenoxy resins, polyesters, polyester-polyether copolymers, bismaleimides, polyimides and mixtures thereof. A preferred thermosettable additive is acrylic alkyd resins. Specifically, it has been found that the addition of acrylic alkyd resin to the epoxy resin provides improved film properties.

Solvent-based coating compositions are suitable for use with the process of this invention. Examples of suitable solvents include neopentane, n-pentane, n-hexane, n-octane, diisopropylketone, cyclohexane, carbon tetrachloride, toluene, xylene, isopropyl alcohol, methylethylketone, etc. Preferred solvents, based on a combination of cost, availability and physical properties, include xylene, methylethylketone, and combinations of xylene and methylethylketone, with butyl cellosolve being added before application to provide an improved appearance. A suitable overall solids content (i.e., the percent of material that does not evaporate during curing of the coating) is typically from about 40% to about 60% by weight.

The platable coatings used in the processes of this invention typically contain a relatively high filler content. Desirably, the filler content is from about 15% to about 40% by weight of the solid (non-volatile) materials in the coating composition. Examples of fillers that may be utilized include barium sulfate, talc, carbonates, zinc oxide, silica, silicates, alumina, aluminates, beryllia, metaborates, calcium sulfate, aluminum silicate, phosphates, metasilicates, zirconates, lithium aluminum silicate, wollastonite, titanates, carbon black, metal particles, metal oxides, and combinations thereof. Preferred fillers, based on a combination of cost, availability and performance properties, include calcium carbonate, silica and alumina. The particle size of the fillers is in the range of from 0.5 μm to 50 μm.

It is desirable to add fumed silica to the coating composition to improve rheology and filler suspension properties, as desired or needed. A suitable amount of fumed silica is typically less than about 8% of the weight of the coating composition.

In order to improve uniform dispersion of the materials in the coating composition, i.e., prevent agglomeration, one or more surfactants may be added, typically in an amount from about 0.5% to about 2.5% of the weight of the coating composition. Some examples of surfactants that can be used include non-ionic surfactants such as polyoxyalkylene alkyl ethers, polyoxyalkylene alkyl phenols, polyoxyalkylene alkyl esters, polyoxyalkylene sorbitan esters, polyoxyethylene glycols, polypropylene glycols and ethylene oxide adducts of diethylene glycol trimethylnonanol; anionic surfactants such as hexylbenzene sulfonic acid, octylbenzene sulfonic acid, decylbenzene sulfonic acid, dodecylbenzene sulfonic acid, acetylbenzene sulfonic acid, myristylbenzene sulfonic acid, and salts thereof; and cationic surfactants such as octyltrimethylammonium hydroxide, dodecyltrimethylammonium hydroxide, hexadecyltrimethylammonium hydroxide, octyldimethylbenzylammonium hydroxide, decyldimethylbenzylammonium hydroxide, and dioctadecyldimethylammonium hydroxide, and salts thereof. Combinations of two or more of these surfactants or similar surfactants can also be used.

Anti-foaming agents may be employed in amounts up to about 2.0% of the weight of the coating composition. Accelerators, such as bisphenol A may be employed in amounts up to about 2.0% by weight of the composition. Reactive diluents, such as glycidyl ester, may be employed in amounts up to about 5% by weight of the coating composition.

The following table provides a typical example of the platable epoxy coating composition.

Example of Typical Platable Epoxy Coating Composition

| Composition | Function | Content, wt. % |
|---|---|---|
| Epoxy resin | Film build-up | 20.0–25.0 |
| Acrylic alkyd resin | Film modification | 8.0–15.0 |
| Xylene, MEP, Butyl Cellosolve, and Butanol, etc. | Solvent | 20.0–35.0 |
| Calcium carbonate | Filler | 15.0–40.0 |
| Surfactant | Dispersant | 0.5–2.5 |
| Aliphatic amines | Cross-Linker | 0.2–4.0 |
| Anti-foaming agents | Deareator | 0.0–2.0 |
| Bisphenol A | Accelerator | 0.0–2.0 |
| Fumed Silica | Rheology | 0.0–8.0 |

-continued

Example of Typical Platable Epoxy Coating Composition

| Composition | Function | Content, wt. % |
|---|---|---|
| Glycidyl ester | Reactive diluent | 0.0–5.0 |
| Total | | 100.0 |

Other suitable platable resins that may be utilized with, or instead of the epoxy resin, include phenol-formaldehyde resin, melamine-formaldehyde resin, urea-formaldehyde resin, polyurethane, unsaturated polyester, phenolic anilyn, furan, polyester, polyphenylene sulfide, polyimide, silicone, poly-p-phenylene benzobisthiazole, polyacrylate, polymethacrylate, novolac, phenolic and alkyd. Compositions based on these resins may be solvent based, using the solvents listed above with respect to the epoxy resin based coating composition, and may contain fillers, surfactants, and rheology modifiers as indicated above, and would typically have a solids content (non-volatile content) of about 40% to about 60% by weight. The resin content (i.e., the amount of material that reacts to form a cross-linked or cured network, including cross-linkers and reactive diluents) is typically from about 28% to about 46% by weight of the liquid coating composition, and comprises from about 60% to about 85% of the weight of the cured film, the balance (about 15% to about 40%) of the cured film being comprised primarily of filler.

After the platable coating has been applied to the substrate, cured and optionally post-cured, it may be desirable to undertake additional preparation steps before metal plating techniques are employed. Specifically, it may be desirable to wet sand the coated components to remove defects and imperfections (such as with a 1200 grit or finer sandpaper), and thereafter rinse and dry the components.

The coated components can be plated using conventional plating chemistry for plating ABS components, except that shorter etching times in the chromic/sulfuric acid mixtures, and longer copper electroplating times are generally desired to achieve superior appearance.

Generally, there are several preparation steps prior to the step of electroplating a decorative metal (such as chrome) layer on the surface of the article. Typically, an electrically conductive electroless coating is provided prior to electroplating of the metal layer(s). Electroless coating generally involves steps of cleaning and etching the substrate, neutralizing the etched surface, catalyzing the neutralized surface (e.g. in a solution that contains palladium chloride, stannous chloride and hydrochloric acid), followed by immersion in an accelerator solution (which is either an acid or a base), and forming a metallic coating on the activated substrate. The surface of the substrate is typically conditioned by cleaning with a detergent solution and etched by dipping the substrate in an etchant (e.g., a mixed solution of chromic acid and sulfuric acid). The metallic coating may be deposited on the activated substrate by immersing the substrate in a chemical plating bath containing nickel or copper ions and depositing the metal thereon from the bath by means of the chemical reduction of the metallic ions. The resulting metallic coating is useful for subsequent electroplating because of its electrical conductivity. It is also conventional to wash the substrate with water after each of the above steps. Other suitable techniques for pretreating a plastic substrate to provide an electrically conductive coating to render the substrate receptive to electroplating operations are well known in the art, and may be employed prior to electroplating a layer of etchable metal on a surface of the article in accordance with the principles of this invention.

The surface of the electrolessly deposited metal layer may be activated by contact with an activating solution prior to subsequent electroplating. For example, a suitable activating solution for subsequent acid copper electroplating is a solution comprising from about 1% to about 15% by weight hydrogen peroxide ($H_2O_2$) and from about 10% to about 30% by weight sulfuric acid ($H_2SO_4$). A suitable contact time with the activation solution is about 5 seconds to about 60 seconds at room temperature, followed by rinsing with water.

Before the chrome or other finish layer is electroplated onto the surface of the plastic component, it may be desirable to electroplate one or more intermediate metal layers over the electrolessly deposited metal layer. Specifically, it may be desirable to utilize a conventional acid copper electroplating process to level or fill light scratches. It may also be desirable to electroplate one or more layers of other metals, particularly nickel, before electroplating chrome or another finish layer. For example, a semi-bright nickel layer may be electroplated onto a previously electroplated metal layer prior to electroplating chrome or another finish layer onto the component. In addition, or alternatively, a bright nickel layer may also be electroplated onto a previously electroplated metal layer prior to electroplating the chrome or other finish layer. In addition, or alternatively, a microporous nickel layer may be electroplated onto the plastic article between a previously electroplated metal layer and the chrome or other finish layer in order to retard corrosion. The electroplating processes may be performed employing well known techniques that are described in the published literature.

Components prepared in accordance with this invention can pass tests for decorative chrome plating specified by the automotive industry, and are visually indistinguishable from a typical chrome plated part on a metal or a plastic substrate.

In order to achieve the best appearance, longer acid copper electroplating, such as up to about two hours, is recommended to level out defects present on the platable resin coating.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A process for electroplating a non-conductive substrate, comprising:

providing a non-conductive substrate;

applying a platable thermosettable coating composition to a surface of the substrate, the thermosettable coating composition comprising:

(a) 20.0-25.0 weight percent epoxy resin;

(b) 8.0-15.0 weight percent acrylic alkyd resin;

(c) 20.0-35.0 weight percent solvent;

(d) 15.0-40.0 weight percent filler;

(e) 0.5-2.5 weight percent surfactant; and (f) 0.2-4.0 weight percent cross-linker;

curing the thermosettable coating composition on the surface of the substrate to convert the thermosettable coating composition to a thermoset layer;

electrolessly plating an electrically conductive coating onto the thermoset layer; and electroplating at least one layer of metal on the electrolessly plated thermoset layer.

2. The process of claim 1, wherein the substrate is comprised of a thermoplastic material.

3. The process of claim 1, wherein the substrate is comprised of a thermoset material.

4. The process of claim 1, wherein the substrate is comprised of a ceramic material.

5. The process of claim 1, wherein the substrate is comprised of artificial or natural fiber material.

6. The process of claim 1, wherein the substrate is comprised of a polycarbonate.

7. The process of claim 1, wherein the substrate is comprised of a cured polyester resin.

8. The process of claim 1, wherein the substrate is comprised of a cured polyacrylate resin.

9. The process of claim 1, wherein the filler is calcium carbonate.

10. The process of claim 9, wherein the filler has the particle size in the range of from 0.5 μm to 50 μm.

11. The process of claim 1, wherein the electroplating includes at least two layers, including a chrome layer.

* * * * *